United States Patent [19]

Yonehara

[11] Patent Number: 5,016,313

[45] Date of Patent: May 21, 1991

[54] SURFACE FINISHING DEVICE

[75] Inventor: Takashi Yonehara, Tokyo, Japan

[73] Assignee: Tokyo Copal Chemical Co., Ltd., Tokyo, Japan

[21] Appl. No.: 352,506

[22] Filed: May 16, 1989

[51] Int. Cl.[5] ..... A47L 11/12; A47L 11/20

[52] U.S. Cl. ..... 15/320; 15/92; 15/380

[58] Field of Search ..... 15/320, 380, 92

[56] References Cited

U.S. PATENT DOCUMENTS

| | | | |
|---|---|---|---|
| 938,089 | 10/1909 | Svoboda et al. | 15/380 |
| 2,260,325 | 10/1941 | Leathers | 15/382 |
| 3,609,787 | 10/1971 | Aurelio et al. | 15/92 X |
| 3,739,417 | 6/1973 | Sawyer | 15/92 |
| 3,754,299 | 8/1973 | Turner | 15/380 X |
| 3,803,666 | 4/1974 | Sawyer | 15/92 X |
| 4,295,243 | 10/1981 | King | 15/380 X |

*Primary Examiner*—Chris K. Moore

*Attorney, Agent, or Firm*—Gifford, Groh, Sprinkle, Patmore and Anderson

[57] ABSTRACT

A surface finishing device having a vibration generator fixedly supported to a device body, a vibration transmitting member disposed at a lower portion of the device body and a heat source incorporated in the vibration transmitting member. The invention also discloses a surface finishing device of the above type further having a fluid-agent outlet opening defined in or in the vicinity of the vibration transmitting member and for discharging a fluid agent or a solution containing the agent.

7 Claims, 5 Drawing Sheets

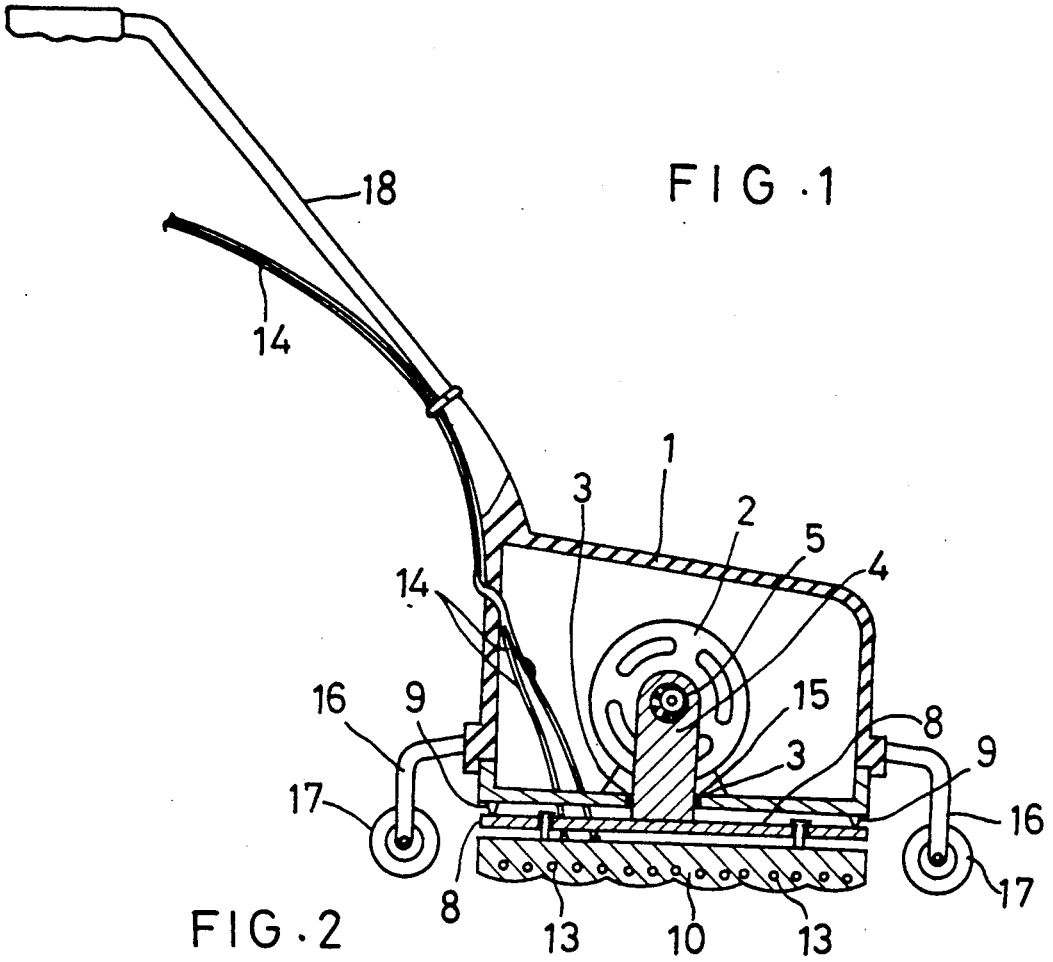
FIG. 1
FIG. 2
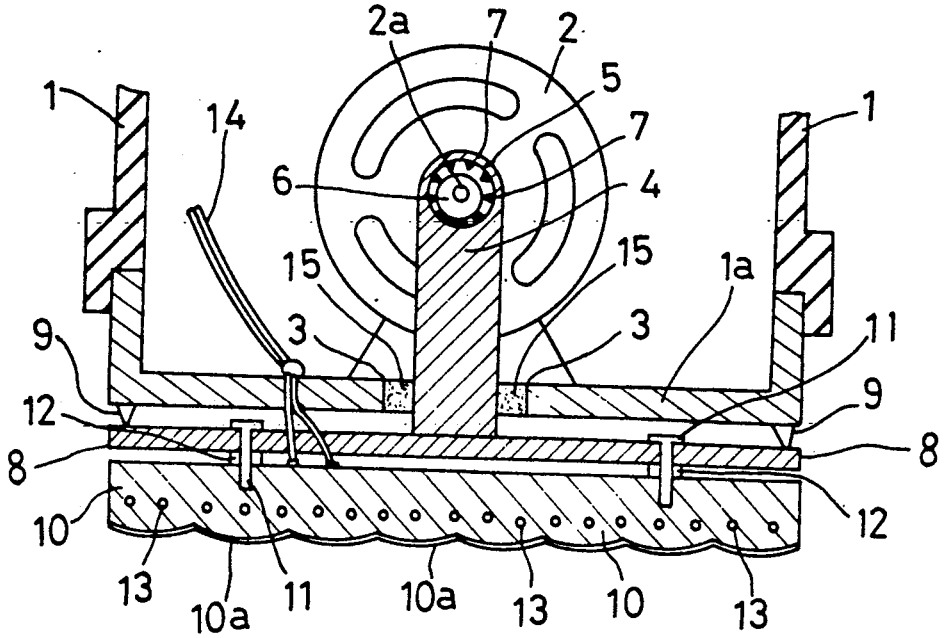

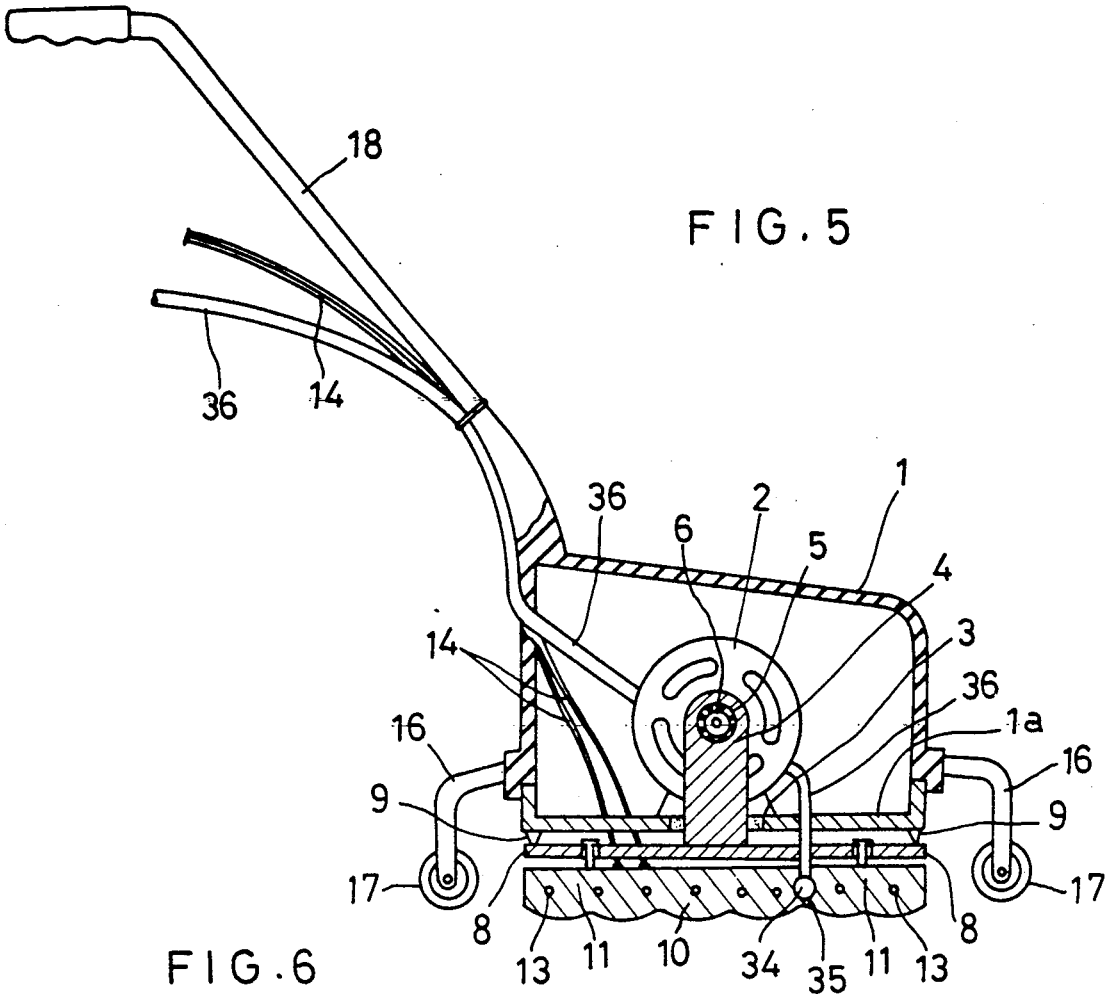
FIG. 5
FIG. 6
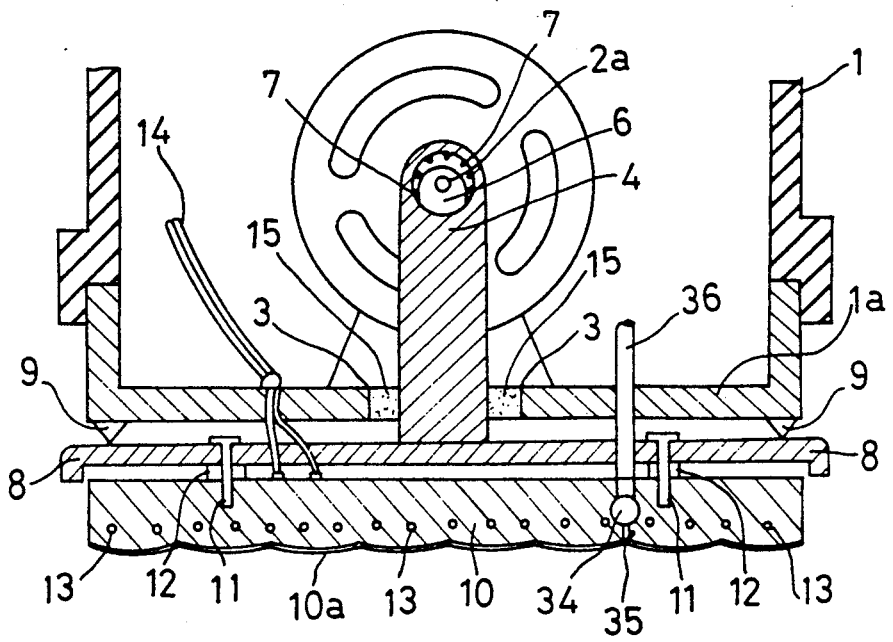

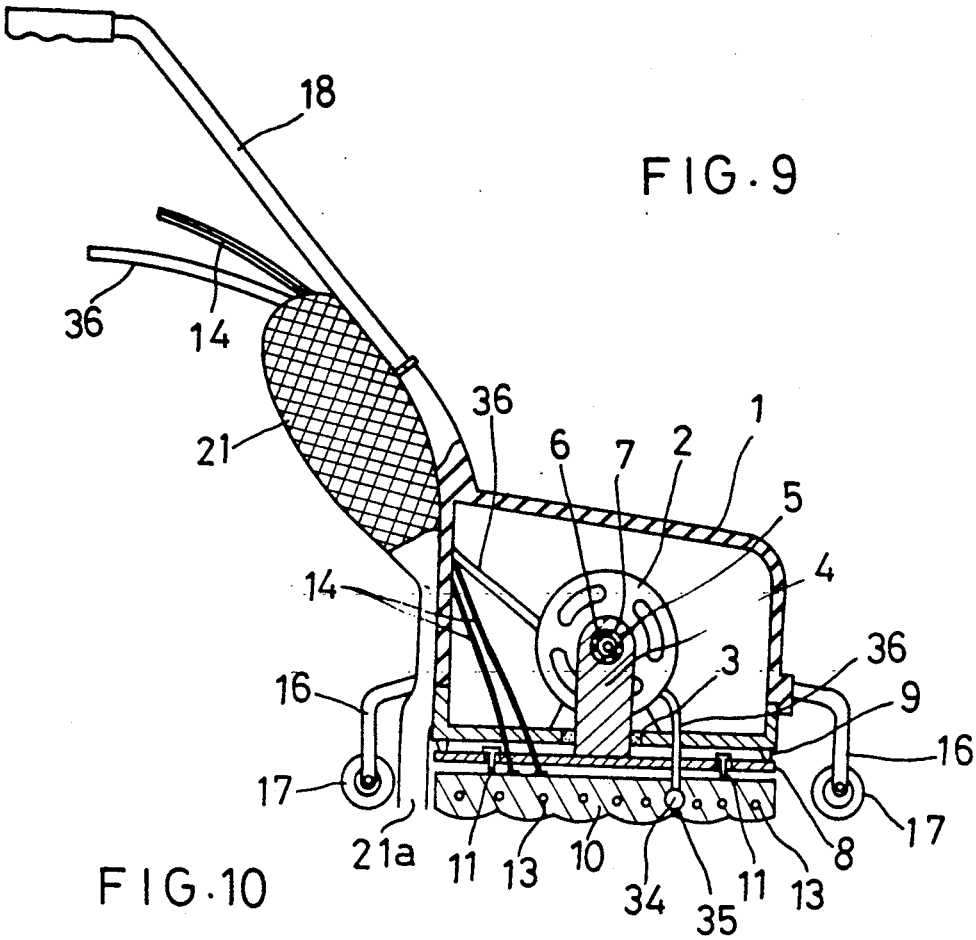
FIG. 9
FIG. 10
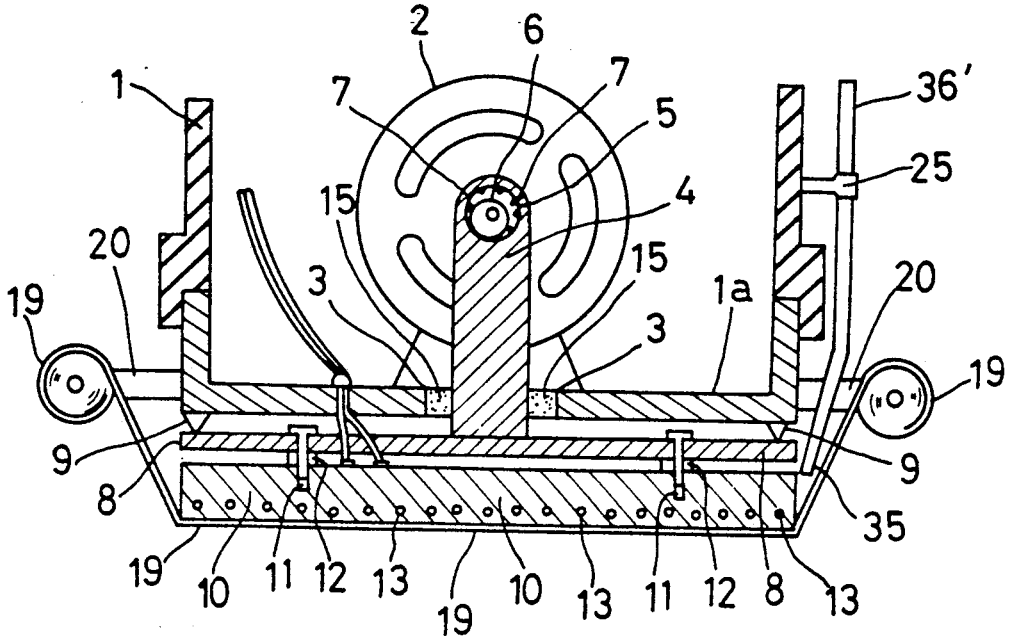

SURFACE FINISHING DEVICE

BACKGROUND OF THE INVENTION

1. Field of the Invention

The present invention relates to a surface finishing device for drying a surface of moist or wet floor, carpet, mat or glass or for applying a chemical agent such as an antistatic agent or other coating agents to a surface of floor, mat or glass.

2. Description of the Prior Art

Conventionally, for drying a surface of moist or wet floor, carpet, mat or glass, a hot-air-blowing fan or a lamp heater has been commonly employed.

Also, when a chemical agent such as an antistatic agent or other painting agents is applied to a surface of floor, mat or glass, the agent is first attached to a brush or a mop and then this brush or mop is applied to the surface to be treated. Alternatively, the agent is sprayed over the surface by means of a sprayer.

With the conventional drying method mentioned above; however, if the surface comprises such hair material as a carpet, the hot air from the fan or the heat from the heater often fails to reach the roots of the carpet piles, whereby the drying operation takes a long time. Moreover, the piling tends to harden after the drying.

With the conventional applying method using a brush or mop as described above, it is difficult to from the coating uniformly and the applying operation per se takes a long time. On the other hand, with the conventional spraying method, only a small portion of the agent is appropriately applied to the target surface while the rest of the agent being inadvertenly dispersed thereabout. Thus, a great amount of the agent is wasted and the scattered agent tends to stick to other objects not to be coated. In addition, this method requires additional means for drying the sprayed agent and takes a long time because of the low efficiency.

SUMMARY OF THE INVENTION

In view of the above-described state of the art, a first object of the invention is overcome the above problems associated with the prior art by providing an improved surface finishing device capable of speedily drying an object to be treated and of providing a soft finish to the object. With this surface finishing device put into use for drying a wet carpet for example, vibration transmitting means incorporating a heat source is brought into contact with the wet surface of the carpet for drying the same. In doing this, the vibration transmitting means effectively increases the contact area between the device and the surface, whereby the drying operation may be carried out speedily. Also, the device may provide a soft finish to the surface.

A second object of the invention is to provide a surface finishing device capable of uniformly and efficiently forming a coating over a surface to be coated. In operation, the device applies a coating agent to a surface to be coated while providing the same with vibration by means of vibration transmitting means. The vibration transmitting means effectively spreads out the agent applied onto the surface, and at the same time the heat source incorporated in the vibration transmitting means comes into pressure contact with the spread agent on the surface thereby efficiently drying the same to form a coating of the agent uniformly over the surface.

As described above, unlike the prior machines which dry the coating liquid from its exterior surface to the interior (i.e. once a coating is formed on the outer surface by drying, the dried coating prevents effective evaporation of the inside liquid thereby delaying the drying operation), the machine of the invention may uniformly form a multi-layered coating. Consequently, the drying operation may be carried out speedily. Especially, if the coating agent is polishing wax or the like to be applied onto the floor surface, the machine may provide a glossy finish by the high density of the wax.

In order to accomplish the first object, a surface finishing device of the invention comprises; a device body; vibration generating means fixedly supported to the device body; vibration transmitting means disposed at a lower position of the device body and for transmitting the vibration of the vibration generating means of the device body to the exterior of the same; wherein the vibration transmitting means incorporates a heat source.

In operation of the surface finishing device with the above feature of the invention, first the device is placed on a wet carpet for example. Then, the heat source incorporated in the vibration transmitting means is powered ON. Upon this, the vibration generating means starts generating vibration to the vibration transmitting means. Then, this vibration transmitting means while being vibrated comes into pressure contact with the wet carpet surface. In doing this, the water contained in the carpet surface may be speedily evaporated and dried by the heat of the heat source in the vibration transmitting means and also by the friction heat caused by the pressure contact between the vibrating vibration transmitting means and the carpet surface.

That is to say, the vibration of the vibration transmitting means effectively increases the contact area between the heat source accommodated therein and the surface to be treated. Accordingly, with this device of the invention, it becomes possible to efficiently and speedily dry even such an agent as an organic solution which is hard to be evaporated or dried by the conventional device.

Similarly, when this device is employed for drying e.g. a solution of antistatic agent applied on a surface of a carpet, the solution is effectively and uniformly spread over the carpet surface by the vibration and the pressure contact of the device, whereby the solution may be dried speedily by the heats and at the same time the coating of the agent may be formed uniformly over the carpet surface. As described above, with the device of the invention, since the vibration transmitting means while being vibrated comes into pressure contact with the object to be dried, the contact area and the contact angle per unit time period between the device and the object may be advantageously increased, whereby the drying operation may be carried out speedily.

Further, with the device of the invention, the vibration transmitting means which is heated per se by the heat source incorporated therein and is vibrated by the vibration generating means is placed into pressure contact with the surface to be treated for drying the same. Then, since the drying operation takes place with the vibration of the device, the drying of the surface takes place only on the surface of the same. Accordingly, the device may be safely used also for an object which is vulnerable to heat. Also, the vibration effectively avoids undesirable hardening of the surface thereby providing a soft finish to the same. Further, when the vibration transmitting means evaporates and dries e.g. water or alcohol content of the solution, the thermal energy resulting from the evaporation effectively kills germs or bacteria adhering to the surface.

Moreover, the vibration helps to direct and travel the device on the surface to the treated, whereby an operator may readily and lightly operate the device by a handle attached to the device.

According to one preferred embodiment of the invention, the vibration transmitting means includes a ceramic layer (e.g. alumina) at a bottom position thereof.

This ceramic layer radiates far-infrared rays having good permeation which promotes transmission of the thermal energy from the device to even the innermost portions of the surface to be treated.

According to a further embodiment of the present invention, the device further comprises: a suction device having an inlet opening in or in the vicinity of the vibration transmitting means and distant from the fluid-agent outlet opening.

This suction device, which is constituted e.g. by a vacuum suction device, takes in the evaporated agent thereby further quickening the drying operation and also takes in dust or the like held in the surface thereby cleaning the same.

In order to accomplish the second object, a surface finishing device of the invention comprises: a device body; vibration generating means fixedly supported to the device body; vibration transmitting means disposed at a lower position of the device body and for transmitting the vibration of the vibration generating means of the device body to the exterior of the same; a heat source incorporated in the vibration transmitting means; a fluid-agent outlet opening defined in or in the vicinity of the vibration transmitting means and for discharging a fluid agent or a solution containing the agent.

When the surface finishing device with the above feature of the invention is put to use for applying a coating agent such as a solution of antistatic agent to a carpet, first, the agent solution is put into a solution tank, and then the vibration generating means and the heat source incorporated in the vibration transmitting means are turned ON. Thereby, the vibration transmitting means starts vibration and comes into pressure contact with the carpet surface. Concurrently therewith, the agent solution is discharged through the solution discharging opening. This discharged solution is effectively and uniformly spread over the carpet surface by the vibration and the pressure contact of the vibration transmitting means. Moreover, since the vibration transmitting means which is heated by the heat source incorporated therein is brought into pressure contact with the carpet surface, the water content in the carpet may be dried speedily by both the heat of the heat source and the heat generated by the frictional contact between the vibrating vibration transmitting means and the carpet surface. In this case also, the vibration and pressure contact of the vibration transmitting means helps to form the coating of the agent uniformly over the carpet surface.

BRIEF DESCRIPTION OF THE DRAWINGS

Accompanying drawings illustrate preferred embodiments of a surface finishing device related to the present invention; in which, FIG. 1 is a side view in partial section of a surface finishing device of an embodiment, FIG. 2 is a section of a major portion in the enlarged scale of the device of FIG. 1, FIG. 5 is a partially sectional side view of a surface finishing device of a further embodiment of the invention, FIG. 6 is a section of the major portion in the enlarged scale of FIG. 5, FIG. 9 is a partially sectional side view of a surface finishing device of a further embodiment of the invention, and FIG. 10 is a section of a major portion in the enlarged scale of a surface finishing device of a further embodiment of the invention.

DESCRIPTION OF THE PREFERRED EMBODIMENT

Figure 3:
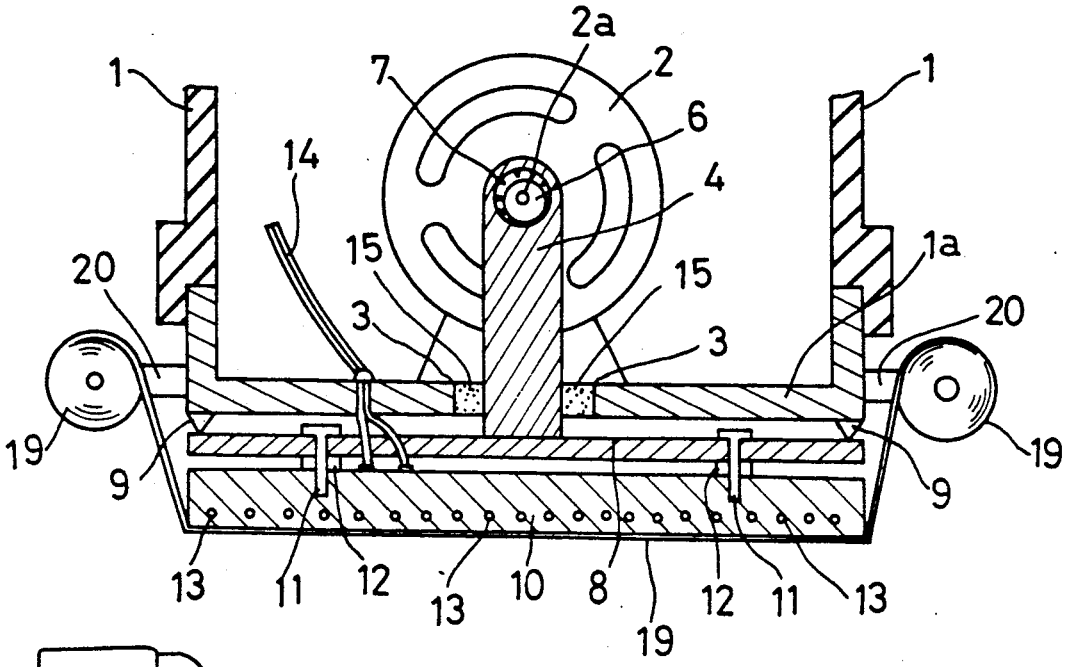
FIG. 3 is a section of a major portion in the enlarged scale of a surface finishing device of a further embodiment of the invention.

Preferred embodiments of the present invention will be particularly described hereinafter with reference to the accompanying drawings.

FIGS. 1 and 2 show a surface finishing device according to a preferred embodiment of the invention; in which, numeral 1 denotes a box type device body, numeral 2 denotes a motor fixedly accommodated in the device body 1, numeral 3 denotes a through hole defined in a bottom plate 1*a* of the device body 1, numeral 4 denotes a vibration-plate supporting member extending through the through hole 3 and having its upper portion supported by a drive shaft 2*a* of the motor 2 inside the body 1, numeral 5 denotes a circular hole defined in an upper portion of each vibration-plate supporting member 4, and numeral 6 denotes an eccentric cam fixedly secured to an outer periphery of the drive shaft 2*a* of the motor 2. This eccentric cam 6 is inserted into the circular hole 5 defined in the vibration-plate supporting member 4. Numeral 7 denotes a bearing interposed respectively between the inner periphery of each circular hole 5 and the outer periphery of each eccentric cam 6. Numeral 8 denotes a vibration plate fixedly secured to a lower end of the vibration-plate supporting member 4 suspended downwardly from the device body 1. Numeral 9 denotes a plurality of vibration supports formed of rubber or the like and provided on the lower face of the bottom plate 1*a* of the device body 1. Lower ends of these supports 9 are placed in contact with the vibration plate 8. Numeral 10 denotes a vibration transmitting member formed of aluminum and attached to the lower face of the vibration plate 8. A lower face of this vibration transmitting member 10 defines a moderate undulation. Reference mark 10*a* denotes a ceramic layer attached to the lower side of the vibration transmitting member 10. Numeral 11 denotes a plurality of screws attached to the lower side of the vibration plate 8 and adapted for supporting the vibration transmitting plate 10 with a slight distance therebetween. Each screw 11 is surrounded at its outer periphery by a heat insulating spacer 12. Numeral 13 denotes a heater coil extended through the interior of the vibration transmitting member 10. Numeral 14 denotes a lead cable for the heater coil 13. Numeral 15 denotes a vibration absorbing packing disposed between the outer periphery of the vibration-plate supporting member 4 and an inner peripheral edge of the through hole 3. Numeral 16 denotes legs projecting forwardly and rearwardly of the device body 1. Each of these legs 16 rotatably supports at a lower end thereof a wheel 17. Numeral 18 denotes a handle extending from an upper end rear position of the device body 1.

Next, operations of the above-described surface finishing device will be described. In the following sample, the device is used for drying an antistatic agent preliminarily applied on a surface of a carpet. First, the device is placed on the carpet surface and the motor 2 and the heater coil 13 are powered ON. Thereby, the vibration transmitting member 10 is heated and also vibrated and comes into pressure contact with the carpet surface. Then, the carpet surface placed into pressure contact with the vibration transmitting member 10 has its agent content evaporated and dried by the friction heat caused by the pressure contact with the vibrating vibration transmitting member and the carpet surface itself and by the heat of the heater coil 13 held in the vibration transmitting member. Concurrently with the drying operation, the vibration of the vibration transmitting member effectively and uniformly spreads the applied agent over the carpet surface. Further, in this embodiment, the vibration transmitting member 10 includes the ceramic layer 10*a* at its lower side. This ceramic layer radiates far-infrared rays which facilitate the heats to reach the innermost portions of the carpet surface thereby effectively drying any agent held at these inner portions also.

In this way, as the device is moved by the operater over the carpet surface, there is uniformly formed a thin coating of the antistatic agent over the entire surface of the carpet including the innermost root portions of the carpet pile.

A drying operation of a wet or moist carpet may be carried out in a like manner by moving the device over the surface of the same.

Accordingly, while the drying operation of water content after cleaning takes 3 to 6 hours by the conventional device, the same may be finished in a significantly reduced period by the device of the present invention.

FIG. 3 shows a surface finishing device according to a second embodiment of the invention. The device of this embodiment is substantially the same as that of the first embodiment except for a cloth 19 attached to the lower side of the vibration transmitting member 10 disposed below the device body 1 and a roll support member 20 rolling opposed ends of the cloth 19 for supporting the same and projecting forwardly and rearwardly from the device body 1.

With the device of this second embodiment, the drying operation of an object such as a wet carpet is effected similarly to that of the previous embodiment by the vibration and the pressure contact of the vibration transmitting member 10 relative to the object. In this embodiment; however, the cloth 19 comes into a direct contact with the object for wiping off or cleaning any dust or dirt adhering to the object surface. When this cloth becomes soiled through operation, the roll is peeled off to reveal a new cloth 19.

Figure 4:
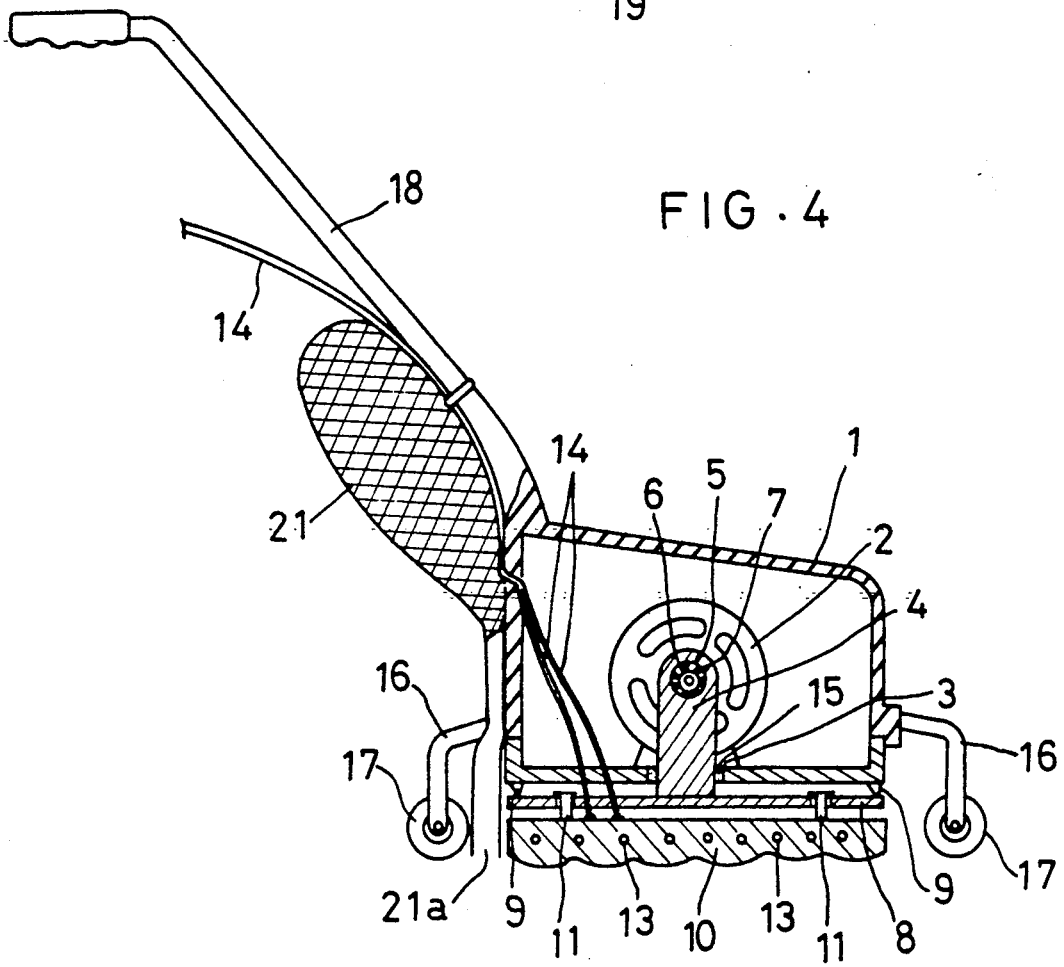
FIG. 4 is a partially sectional side view of a surface finishing device of a still further embodiment of the invention.

FIG. 4 shows a surface finishing device according to a third embodiment of the invention. The device of this third embodiment is the same as that of the first embodiment except for a vacuum suction device 21 attached to a rear portion of the device body 1 and having its inlet, i.e. suction opening 21*a* disposed adjacent a rear portion of the vibration transmitting member 10.

With the device of this third embodiment, as the device operates for drying the object in the manner described hereinbefore, the suction device 21 takes in such matter as moist air which is generated in the course of the drying operation, whereby the operation of the suction device 21 further promotes the drying operation and also takes in the dirt or dust floated up to the object surface by the vibration of the vibration transmitting member 10.

Figure 7:
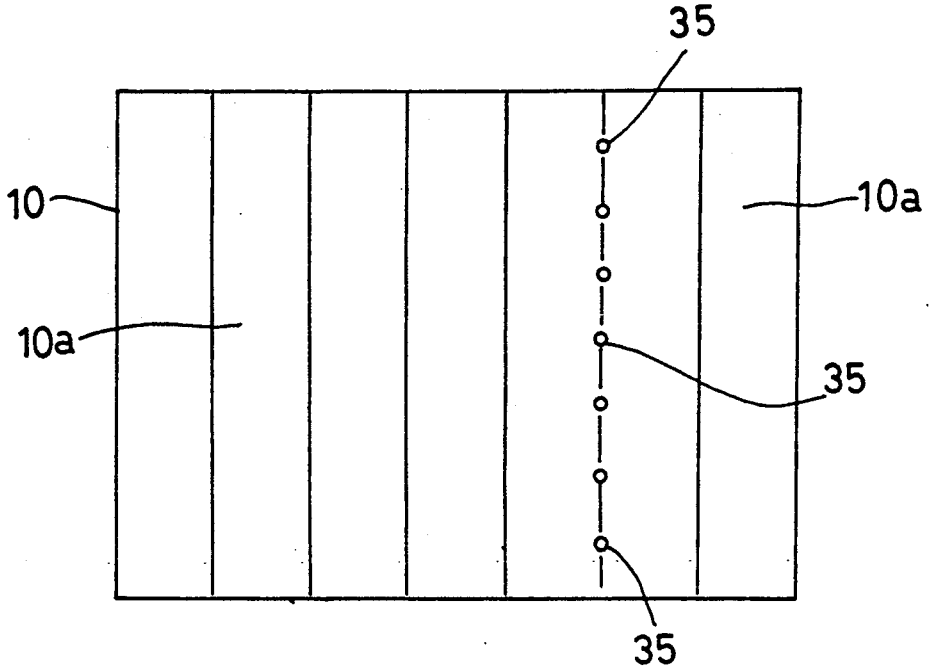
FIG. 7 is a bottom view showing a vibration transmitting member of the device shown in FIG. 6.

FIGS. 5 through 7 illustrate a surface finishing device related to a fourth embodiment of the present invention. The device of this fourth embodiment is the same as that of the first embodiment except for a fluid solution pipe 34 disposed inside the vibration transmitting member 10 attached to the lower side of the device body 1 and a fluid solution discharge opening 35 extending from the pipe 34 to the lower side of the vibration transmitting member 10, such that a fluid solution of e.g. antistatic agent may be discharged and applied to e.g. a floor surface of an object to be treated.

Actually, the fluid solution discharge opening 35 is provided by a plurality of units over the lower side of the vibration transmitting member 10 with an appropriate distance each other. Further, numeral 36 denotes a pipe extending from the exterior of the device body 1 and passing through the interior of the same and communicated at one end thereof with the fluid solution pipe 34 disposed inside the vibration transmitting member 10. The other end of the pipe 36 is connected with an unillustrated solution tank and an unillustrated pump.

Next, operations of the device of this embodiment will be described.

First, a solution of antistatic agent is introduced into the unillustrated solution tank. Then, this solution is fed by the pump through the pipe 36 to the fluid solution pipe 34 of the vibration transmitting member 10. Thereafter, with a power-ON of the motor 2, the eccentric cam 6 rotates to vibrate the vibration-plate supporting member 4, thereby vibrating the vibration plate 8 and the vibration transmitting member 10 in unison therewith.

With the above operation, the antistatic agent solution now held inside the pipe 34 is discharged little by little through the discharge opening 35 at the lower side of the vibration transmitting member 10. In this condition, the operator pushes the device body 1 by the handle 18 to move the same onto a carpet to be treated. With the vibration of the device, the dust or dirt held in the carpet pile is caused to float up to the top end of the carpet pile, and concurrently therewith the antistatic agent solution effeciently permeates to the innermost portion of the carpet pile. In doing this, the vibration of the vibration transmitting member 10 effectively spreads the solution uniformly over the carpet surface. Moreover, with a power-ON of the heater coil 13 inside the vibration transmitting member 10, the ceramic layer 10*a* attached to the lower side of the vibration transmitting member 10 radiates far-infrared rays which help transmission of the thermal energy to reach the innermost portions of the carpet pile for drying the same. Accordingly, the drying operation is further quickened by the effect of vibration which intermittently brings the device into pressure contact with the carpet surface.

As the device is gradually moved over the surface in the above-described manner, there is formed a coating of the antistatic agent solution uniformly over the surface even at the innermost portions of the same.

Figure 8:
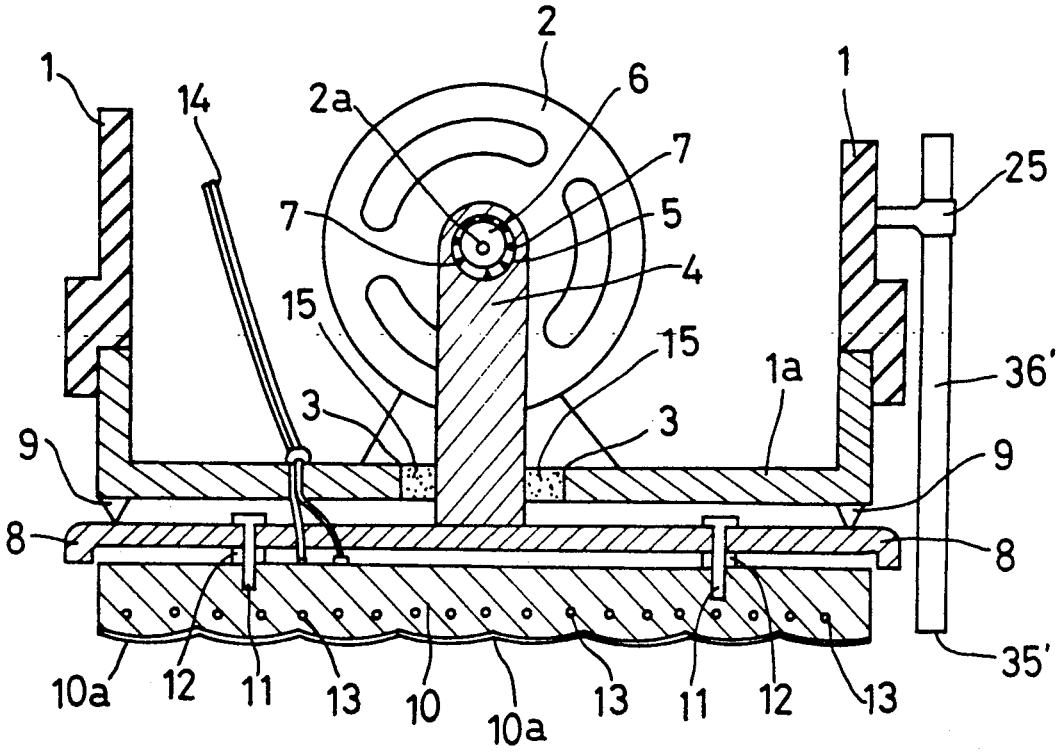
FIG. 8 is a section of a major portion in the enlarged scale of a surface finishing device of a further embodiment of the invention.

FIG. 8 shows a surface finishing device related to a fifth embodiment of the present invention. A solution pipe 36' of the device of this embodiment, unlike its equivalent of the above-described fourth embodiment, is extended outwardly from the device body 1 and supported by a support member 25. Also, a solution discharge opening 35' is positioned adjacent the vibration transmitting member 10.

Functions and effects of the device of this embodiment are substantially the same as those of the previous embodiments.

FIG. 9 shows a surface finishing device related to a sixth embodiment of the present invention. The device of this sixth embodiment is substantially the same as that of the fourth embodiment except for the vacuum suction device 21 attached to the rear position of the device body 1 and its inlet openings 21*a* positioned adjacent the rear portion of the vibration transmitting member 10.

With the device of this embodiment in operation, the agent solution is caused to adhere to the surface to be treated and dried by the vibration transmitting member 10 incorporating the heater coil. Simultaneously therewith, the suction device takes in the moist air generated by the evaporation of the water content and also dust or dirt floated up to the carpet surface by the vibration of the vibration transmitting member 10. Accordingly, even such organisms as ticks held in the carpet pile may be caused to float up to the top ends of the carpet pile because of the reduced static electricity and then efficiently removed therefrom by the suction device. Alternately, the organisms may be killed by the thermal energy of the device and their bodies are effectively removed by the suction device.

That is to say, the device of this embodiment is capable of not only drying or applying an agent to an object surface but also of removing and cleaning dust, dirt or organisms held in the object.

FIG. 10 shows a surface finishing device related to a seventh embodiment of the present invention. The device of this seventh embodiment is substantially the same as that of the fifth embodiment except for the cloth 19 attached to the lower side of the vibration transmitting member 10 disposed below the device body 1 and the roll support member 20 rolling opposed ends of the cloth 19 for supporting the same and projecting forwardly and rearwardly from the device body 1.

With the device of this embodiment, the drying operation of an object such as a wet carpet is effected similarly to that of the previous embodiments by the vibration and the pressure contact of the vibration transmitting member 10 relative to the object. In this embodiment; however, the cloth 19 comes into a direct contact with the object for wiping off or cleaning any dust or dirt adhering to the object surface. When this cloth becomes soiled through operation, the roll is peeled off to reveal a new cloth 19. Needless to say, the solution discharge opening 35 of this embodiment may be disposed either outwardly or inwardly of the vibration transmitting member 10.

In the above described embodiments, the motor 2 is used for generating the vibration. In place of this; however, various types of vibration generating means may be used such as the electromagnetic type device or a device utilizing supersonic waves. And, the vibration may range approximately between 10 Hz to 10 MHz.

Also, in the previous embodiment, the vibration transmitting member 10 includes the ceramic layer 10*a* at the bottom side thereof. However, when the far-infrared rays are not necessary, the bottom side of the same may be provided with a resin treatment such as of Teflon or a metal plating. Also, the vibration transmitting member 10 may be formed not only of the metal but also of other materials such as ceramics, cushion material, plastics, woven fabric, non woven fabric or brush.

Further, the vibration transmitting member 10 may be formed, in place of the aluminum employed in the embodiment, also from copper which is also a good heat conductor. Still alternately, the member 10 may be formed not only such metals but also other materials suitable for vibration transmission such as ceramics, cushioning material, plastics, woven fabric, non-woven fabric, brush, and so on. If this vibration transmitting member is formed of such material which is a good conductor of not only heat but also of electricity, the heat wire embedded in this member should be coated with an appropriate insulating material. Then, there will occur no safety problem.

Further, the wheels 17 used in the embodiments are for allowing easy transport of the device when the same is out of service. Therefore, it is conceivable to arrange these wheels such that the same are lifted up during the operation of the device. Also, the heat source incorporated in the vibration transmitting member may comprise not only the heater but also other types of devices.

Still further, in place of the hand-propelling type described thus far, it is also conceivable to adapt the machine to be operable by a remote controller.

What is claimed is:

1. A surface finishing device comprising:

a device body;

vibration generating means fixedly supported to the device body;

vibration transmitting means disposed at a lower portion of said device body opposing a floor surface and for transmitting the vibration of said vibration generating means of the device body to the exterior of the same;

wherein said vibration transmitting means is vertically vibrated through mechanical means and incorporates a heat source positioned substantially all over the surface of the portion opposed to the floor surface.

2. A surface finishing device as defined in claim 1, wherein said vibration transmitting means further comprises a vibration transmitting member supported beneath said device body, said member includes a ceramic layer at a bottom portion thereof.

3. A surface finishing device as defined in claim 2 further comprising:

a suction device having an inlet opening positioned adjacent the rear portion of said vibration transmitting member.

4. A surface finishing device comprising:

a device body;

vibration generating means fixedly supported to the device body;

vibration transmitting means disposed at a lower portion of said device body and for transmitting the vibration of said vibration generating means of said device body to the exterior of the same;

a heat source incorporated in said vibration transmitting means;

a fluid-agent outlet opening defined in said vibration transmitting means for discharging a fluid agent or a solution containing the agent.

5. A surface finishing device as defined in claim 4, wherein said vibration transmitting means further comprises a vibration transmitting member supported beneath said device body, said member includes a ceramic layer at a bottom portion thereof.

6. A surface finishing device as defined in claim 5, further comprising;

a suction device having an inlet opening positioned adjacent the rear portion of said vibration transmitting member and distant from said fluid-agent outlet opening.

7. A surface finishing device as defined in claim 4, wherein said fluid agent is an antistatic agent for a carpet.

* * * * *